US010920173B2

(12) United States Patent
Sakuraba et al.

(10) Patent No.: US 10,920,173 B2
(45) Date of Patent: Feb. 16, 2021

(54) LIQUID DETERGENT COMPOSITION

(71) Applicant: KAO CORPORATION, Tokyo (JP)

(72) Inventors: Ayako Sakuraba, Wakayama (JP); Tetsuya Uchiyama, Tokyo (JP)

(73) Assignee: KAO CORPORATION, Tokyo (JP)

( * ) Notice: Subject to any disclaimer, the term of this patent is extended or adjusted under 35 U.S.C. 154(b) by 190 days.

(21) Appl. No.: 16/305,820

(22) PCT Filed: May 30, 2017

(86) PCT No.: PCT/JP2017/019986
§ 371 (c)(1),
(2) Date: Nov. 29, 2018

(87) PCT Pub. No.: WO2017/209085
PCT Pub. Date: Dec. 7, 2017

(65) Prior Publication Data

US 2020/0231899 A1 Jul. 23, 2020

(30) Foreign Application Priority Data

May 31, 2016 (JP) ..... 2016-108053

(51) Int. Cl.

| | |
|---|---|
| ***C11D 1/00*** | (2006.01) |
| ***C11D 1/14*** | (2006.01) |
| ***C11D 1/04*** | (2006.01) |
| ***C11D 1/66*** | (2006.01) |
| ***C11D 3/20*** | (2006.01) |
| ***C11D 3/43*** | (2006.01) |
| ***C11D 11/00*** | (2006.01) |

(52) U.S. Cl.
CPC ..... *C11D 1/143* (2013.01); *C11D 1/04* (2013.01); *C11D 1/66* (2013.01); *C11D 3/2003* (2013.01); *C11D 3/2068* (2013.01); *C11D 3/43* (2013.01); *C11D 11/0017* (2013.01)

(58) Field of Classification Search
None
See application file for complete search history.

(56) References Cited

U.S. PATENT DOCUMENTS 5,078,916 A * 1/1992 Kok ..... C11D 1/143 510/488
2014/0076345 A1 3/2014 Fujii et al.
2014/0079658 A1 3/2014 Terazaki et al.
2015/0182438 A1 7/2015 Fujii et al.
2015/0202134 A1* 7/2015 Yoshikawa ..... A61Q 19/10 510/127
2018/0265807 A1* 9/2018 Morimoto ..... A61K 8/86

FOREIGN PATENT DOCUMENTS

| | | | |
|---|---|---|---|
| EP | 0 377 261 | A2 | 7/1990 |
| GB | 1217137 | A | 12/1970 |
| JP | 2003-81935 | A | 3/2003 |
| JP | 2014-76983 | A | 5/2014 |
| JP | 2015-27975 | A | 2/2015 |
| JP | 2015-27977 | A | 2/2015 |
| JP | 2017-214570 | A | 12/2017 |
| WO | WO 2015/14699 | A1 | 9/2015 |

OTHER PUBLICATIONS

Extended European Search Report for European Application No. 17806639.5, dated Nov. 20, 2019.
International Search Report for PCT/JP2017/019986 (PCT/ISA/210) dated Jul. 4, 2017.

* cited by examiner

*Primary Examiner* — Necholus Ogden, Jr.
(74) *Attorney, Agent, or Firm* — Birch, Stewart, Kolasch & Birch, LLP

(57) ABSTRACT

There is provided a liquid detergent composition comprising an internal olefin sulfonate salt at a high concentration and being excellent in stability at low temperatures without lowering the detergency. The liquid detergent composition comprises the following components (A) to (D), wherein a mass ratio of the component (A) to a total amount of the component (B) and the component (C), (A/(B+C)), is 0.6 or more and 5 or less; and a mass ratio of the component (B) to the component (C), (B/C), is 0.05 or more and 1.8 or less. (A): 10 to 40% by mass of an internal olefin sulfonate salt having 16 to 18 carbon atoms in which a content of an internal olefin sulfonate salt having a sulfonic group at the C-2 position is 5% by mass to 25% by mass; (B): 0.5 to 16% by mass of a fatty acid salt represented by the following formula (1): $R^1COOM$ (1) wherein $R^1$ represents an alkyl group or alkenyl group having 10 or more and 14 or less carbon atoms; and M represents a hydrogen atom, an alkali metal, alkaline earth metal (½ atom), ammonium or an organic ammonium; (C): an organic solvent having one or more hydroxyl groups; and (D) water.

14 Claims, No Drawings

LIQUID DETERGENT COMPOSITION

FIELD OF THE INVENTION

The present invention relates to a liquid detergent composition.

BACKGROUND OF THE INVENTION

As detergent compositions for clothes, granular detergent compositions and liquid detergent compositions are mainly used. In recent years, liquid detergent compositions have become the mainstream, in terms of easiness of weighing and prevention of remaining undissolved in washing containers. Further, when liquid detergents are of a concentrated type, since the size of the detergent compositions themselves can be made small, use thereof enables a reduction in the amount of resins for containers, a reduction in the transportation cost, a reduction in refuse after use, and the like, and is conceivably very effective to reduce environmental load. Also in the fields of detergents for tableware and the like, liquid detergent compositions of a concentrated type are broadly used.

Meanwhile, an internal olefin sulfonate salt obtained by sulfonating an internal olefin having a double bond inside an olefin chain is an anionic surfactant which is excellent in solubilizing ability, penetrating ability and interfacial tension reducing ability. It is disclosed in Patent Literature 1 that as a result of various studies conducted on the position of a double bond in internal olefins, a detergent composition containing an internal olefin sulfonate salt, obtained by using, as a raw material, an internal olefin in which the total proportion of an internal olefin having a double bond at the C-2 position of the carbon chain is from 20 to 95%, is excellent particularly in detergency and penetrating ability. Patent Literature 2 discloses a detergent composition containing an internal olefin sulfonate salt and states that the composition is excellent in cleaning performance.

Patent Literature 1: JP-A-2003-81935

Patent Literature 2: EP0377261A

SUMMARY OF THE INVENTION

The present invention provides a liquid detergent composition comprising the following components (A) to (D), wherein the mass ratio of the component (A) to a total amount of the component (B) and the component (C), (A/(B+C)), is 0.6 or more and 5 or less; and the mass ratio of the component (B) to the component (C), (B/C), is 0.05 or more and 1.8 or less.

(A): 10 to 40% by mass of an internal olefin sulfonate salt having 16 or more and 18 or less carbon atoms in which a content of an internal olefin sulfonate salt having a sulfonic group at the C-2 position is 5% by mass or more and 25% by mass or less, (B): 0.5 to 16% by mass of a fatty acid salt represented by the following formula (1)

$$R^1COOM \quad (1)$$

wherein $R^1$ represents an alkyl group or alkenyl group having 10 or more and 14 or less carbon atoms; and M represents a hydrogen atom, an alkali metal, alkaline earth metal (½ atom), ammonium or an organic ammonium, (C): an organic solvent having one or more hydroxyl groups (D): water

DETAILED DESCRIPTION OF THE INVENTION

Patent Literature 1 describes no specific example of a liquid detergent composition; and Patent Literature 2 includes no description about the position of the double bond of an internal olefin, as a raw material of an internal olefin sulfonate salt used therein, and the proportion thereof.

The present inventors began studies to develop a liquid detergent of a concentrated type having an internal olefin sulfonate salt blended therein and found that when the internal olefin sulfonate salt is blended at a high concentration, such a problem that crystals are liable to deposit at low temperatures arises.

Therefore, the present invention is to provide a liquid detergent composition comprising an internal olefin sulfonate salt at a high concentration and being excellent in stability at low temperatures without lowering the detergency.

Then, as a result of various studies, the present inventors found that by using an internal olefin sulfonate salt in which the position of a double bond therein and the content thereof are in specific ranges first, and combining such an internal olefin sulfonate salt with a specific fatty acid salt and a specific organic solvent in specific amounts, there can be obtained a liquid detergent composition of a concentrated type which maintains excellent detergency and is good in low-temperature stability and aims at reducing environmental load.

Even when the liquid detergent composition according to the present invention is a concentrated type comprising an internal olefin sulfonate salt at a high concentration, deposition of crystals at low temperatures can be suppressed.

[Component (A)]

The liquid detergent composition according to the present invention comprises an internal olefin sulfonate salt having 16 or more and 18 or less carbon atoms in which a content of an internal olefin sulfonate salt having a sulfonic group at the C-2 position is 5% by mass or more and 25% by mass or less (hereinafter, referred to also as component (A)).

The internal olefin sulfonate salt in the present invention means a sulfonate salt obtained by sulfonating an internal olefin (an olefin having a double bond the inside the olefin chain) having 16 or more and 18 or less carbon atoms, as a raw material, and neutralizing and hydrolyzing the resultant. Here, such an internal olefin has a broad meaning, including also the case of containing a so-called α-olefin, in which the double bond is present at position 1 of the carbon chain, in a trace amount. That is, when an internal olefin is sulfonated, β-sultone is quantitatively produced, and part of the β-sultone turns to γ-sultone and an olefin sulfonic acid; and which are further converted to a hydroxyalkane sulfonate salt and an olefin sulfonate salt in a neutralization hydrolysis step (for example, J. Am. Oil Chem. Soc. 69, 39(1992)). Here, the hydroxy group of the obtained hydroxyalkane sulfonate salt is present in the inside of the alkane chain, and the double bond of the olefin sulfonate salt is present in the inside of the olefin chain. Then, an obtained product is mainly a mixture of these; and the product partially contains a trace amount of a hydroxyalkane sulfonate salt having a hydroxy group at a terminal of the carbon chain, or a trace amount of an olefin sulfonate salt having a double bond at a terminal of the carbon chain, in some cases. In the present description, a mixture of the hydroxyalkane sulfonate salt and the olefin sulfonate salt is generically termed an internal olefin sulfonate salt. Then, the hydroxyalkane sulfonate salt is termed a hydroxy form (hereinafter, also termed HAS) of the internal olefin sulfonate salt; and the olefin sulfonate salt is termed an olefin form (hereinafter, also termed IOS) of the internal olefin sulfonate salt. Then, the internal olefin sulfonate salt in which a content of an internal olefin sulfonate salt having a sulfonic group at the C-2 position is 5% by mass or more and 25% by mass or less is taken as the component (A).

The number of carbon atoms of the internal olefin sulfonate salt as the component (A) is preferably 16 or more and 18 or less from the viewpoint of exhibiting a favorable cleaning function. The hydroxy form and the olefin form having these various numbers of carbon atoms are originated from an internal olefin to be used as a raw material, and the hydroxy form and the olefin form having carbon atoms in numbers different from the above number of carbon atoms may be contained.

The internal olefin sulfonate salt as the component (A) may be an internal olefin sulfonate salt having 16 carbon atoms or an internal olefin sulfonate salt having 18 carbon atoms, but is preferably a mixture of an internal olefin sulfonate salt having 16 carbon atoms and an internal olefin sulfonate salt having 18 carbon atoms. Specifically, the mass ratio of a content of an internal olefin sulfonate salt having 16 carbon atoms to a content of an internal olefin sulfonate salt having 18 carbon atoms (an internal olefin sulfonate salt having 16 carbon atoms/an internal olefin sulfonate salt having 18 carbon atoms) is, from the viewpoint of imparting the detergency improvement and the rinsability improvement, preferably from 50/50 to 99/1, more preferably from 60/40 to 95/5, even more preferably from 70/30 to 90/10, further preferably from 75/25 to 90/10, and further preferably from 75/25 to 85/15. The mass ratio of an internal olefin sulfonate salt having 16 carbon atoms/an internal olefin sulfonate salt having 18 carbon atoms can be determined by separating the internal olefin sulfonate salt having 16 carbon atoms and the internal olefin sulfonate salt having 18 carbon atoms by HPLC, and subjecting each of these to MS (mass spectrometry) to identify them and using their HPLC-MS peak areas.

The upper limit of the content of the internal olefin sulfonate salt having a sulfonic group at the C-2 position in the component (A) is, from the viewpoint of the good detergency and the low-temperature stability and particularly from the viewpoint of preventing the crystal deposition at low temperatures, preferably 25% by mass or less, more preferably 23% by mass or less, even more preferably 20% by mass or less, and further preferably 18% by mass or less. Then the lower limit of the content of the internal olefin sulfonate salt having a sulfonic group present at C-2 position in the component (A) is, from the viewpoint of reducing the production cost and improving the productivity, preferably 5% by mass or more, more preferably 6% by mass or more, even more preferably 7% by mass or more, further preferably 8% by mass or more, further preferably 9% by mass or more, further preferably 10% by mass or more, further preferably 12% by mass or more, further preferably 14% by mass or more, and further preferably 16% by mass or more.

The specific range of the content of the internal olefin sulfonate salt having a sulfonic group at the C-2 position in the component (A) is from 5 to 25% by mass, preferably from 6 to 23% by mass, more preferably from 7 to 20% by mass, even more preferably from 8 to 20% by mass, further preferably from 9 to 20% by mass, further preferably from 10 to 20% by mass, further preferably from 12 to 20% by mass, further preferably from 14 to 20% by mass, and further preferably from 16 to 20% by mass.

Here, the content of the internal olefin sulfonate salt having a sulfonic group at the C-2 position in the component (A) can be measured by gas chromatography. Specifically, a method using gas chromatography described in Examples described later is preferable.

The mass ratio of a content of the hydroxy form to a content of the olefin form (hydroxy form/olefin form) in the internal olefin sulfonate salt as the component (A) is, from the viewpoint of the cleaning performance, preferably from 50/50 to 100/0, more preferably from 60/40 to 100/0, even more preferably from 70/30 to 100/0, further preferably from 75/25 to 100/0, and further preferably from 75/25 to 95/5.

The mass ratio of a content of the hydroxy form to a content of the olefin form in the internal olefin sulfonate salt as the component (A) can be measured by separating the hydroxy form and the olefin form by HPLC, and thereafter using a method described in Examples.

The content of the component (A) in the liquid detergent composition is, from the viewpoint of being made of a concentrated type and the low-temperature stability, 10% by mass or more and 40% by mass or less, but is, from the viewpoint of the stability at low temperatures, preferably 35% by mass or less, more preferably 30% by mass or less, and even more preferably 25% by mass or less. The specific range of the content of the component (A) in the liquid detergent composition is from 10 to 40% by mass, preferably from 10 to 35% by mass, more preferably from 10 to 30% by mass, and even more preferably from 10 to 25% by mass.

The internal olefin sulfonate salt (A) can be obtained by sulfonating an internal olefin having 16 to 18 carbon atoms as a raw material, and neutralizing and hydrolyzing the resultant. The conditions of the sulfonation, the neutralization and the hydrolyzation are not especially limited, and, for example, conditions described in JP-B-1633184 and JP-B-2625150 and Tenside Surf. Det. 31(5) 299(1994) can be referred to.

[Component (B)]

The component (B) is a fatty acid or a salt thereof represented by the following formula (1).

$$R^1COOM \quad (1)$$

wherein $R^1$ represents an alkyl group or alkenyl group having 10 or more and 14 or less carbon atoms; and M represents a hydrogen atom, an alkali metal, alkaline earth metal (½ atom), ammonium or an organic ammonium.

In the above formula (1), from the viewpoint of suppressing crystallization of the component (A) at low temperatures and suppressing deposition thereof, $R^1$ is an alkyl group or alkenyl group having 10 or more and 14 or less carbon atoms, and preferably an alkyl group or alkenyl group having 12 carbon atoms. Then, M is a hydrogen atom, an alkali metal, an alkaline earth metal (½ atom), ammonium or an organic ammonium, preferably an alkali metal, ammonium or an organic ammonium, more preferably an alkali metal or an organic ammonium, and even more preferably an organic ammonium.

Specifically, the alkali metal includes potassium and sodium. The organic ammonium includes alkanolamines, such as monoethanolamine, N-methylethanolamine, N,N-dimethylethanolamine, N, N-diethylethanolamine, diethanolamine, N-methyldiethanolamine and triethanolamine. Among these, from the viewpoint of improving the stability at low temperatures of the component (A), monoethanolamine and triethanolamine are preferable and monoethanolamine is more preferable.

Here, the component (A) may be blended as a fatty acid salt in advance, but a fatty acid and a base may be blended to form a fatty acid salt in the composition.

The content of the component (B) in terms of acid in the liquid detergent composition according to the present invention is, from the viewpoint of suppressing the deposition of the component (A) at low temperatures and suppressing foamability during cleaning, more preferably 0.5% by mass or more, and even more preferably 1.0% by mass or more. Further from the viewpoint of suppressing the deposition of the component (A) at low temperatures and suppressing a rise in the viscosity of the liquid detergent composition, the content is preferably 16% by mass or less, more preferably 15% by mass or less, even more preferably 10% by mass or less, further preferably 8% by mass or less, and further preferably 7% by mass or less.

The specific range of the content of the component (B) is from 0.5 to 16% by mass, preferably from 0.5 to 15% by mass, more preferably from 0.5 to 10% by mass, even more preferably from 1 to 8% by mass, and further preferably from 1 to 7% by mass.

[Component (C)]

The component (C) is an organic solvent having one or more hydroxyl groups.

By combining the component (A) according to the present invention with the component (B) and the component (C), the crystallization of the component (A) at low temperatures can more efficiently be suppressed. The organic solvent having one or more hydroxyl groups as the component (C) includes one or more selected from the group consisting of monohydric alcohols, polyhydric alcohols and polyhydric alcohol ethers. The organic solvent more specifically includes one or more selected from the group consisting of the following components (c1) to (c6).

(c1): Monohydric alcohols having an aliphatic hydrocarbon group having 2 or more and 6 or less carbon atoms Examples thereof include ethanol, 1-propanol, 2-propanol and 1-butanol.

(c2): Di- or more hydric and hexa- or less hydric alcohols having 2 or more and 6 or less carbon atoms (excluding component (c3))

Examples thereof include ethylene glycol, propylene glycol, butylene glycol, hexylene glycol (2-methyl-2,4-pentanediol), 1,5-pentanediol, 1,6-hexanediol and glycerol.

(c3): Polyalkylene glycols containing an alkylene glycol unit having 2 or more and 4 or less carbon atoms Examples thereof include diethylene glycol, triethylene glycol, tetraethylene glycol, dipropylene glycol, tripropylene glycol, polyethylene glycol having a weight-average molecular weight of 400 or more and 4,000 or less, and polypropylene glycol having a weight-average molecular weight of 400 or more and 4,000 or less.

(c4): Monoalkyl ethers of (mono or poly)alkylene glycols, having an alkylene glycol unit having 2 or more and 4 or less carbon atoms and an alkyl group having 1 or more and 4 or less carbon atoms Examples thereof include diethylene glycol monomethyl ether, triethylene glycol monomethyl ether, diethylene glycol monoethyl ether, dipropylene glycol monomethyl ether, dipropylene glycol monoethyl ether, tripropylene glycol monomethyl ether, ethylene glycol monobutyl ether, diethylene glycol monobutyl ether, 1-methoxy-2-propanol and 1-ethoxy-2-propanol.

(c5): Alkyl glyceryl ethers having alkyl having 1 or more and 8 or less carbon atoms Examples thereof include 1-methyl glycerol ether, 2-methyl glycerol ether, 1,3-dimethyl glycerol ether, 1-ethyl glycerol ether, 1,3-diethyl glycerol ether, triethyl glycerol ether, 1-pentyl glyceryl ether, 2-pentyl glyceryl ether, 1-octyl glyceryl ether and 2-ethylhexyl glyceryl ether.

(c6): Aromatic compounds having an alcoholic hydroxyl group

Examples thereof include 2-phenoxyethanol, benzyl alcohol, diethylene glycol monophenyl ether, triethylene glycol monophenyl ether, polyethylene glycol monophenyl ether having an average molecular weight of about 480, 2-benzyloxyethanol and diethylene glycol monobenzyl ether.

Among these, (c1), (c2), (c4) and (c6) are preferable from the viewpoint of antisepticity, detergency and suppression of crystallization, and (c1), (c4) and (c6) are more preferable. Further these solvents can be used in a combination of some thereof. Specifically, (c1) and (c4), or (c1), (c4) and (c6) can be combined. By combining some of the solvents, the effect of suppressing crystallization can be enhanced. More specifically, it is preferable to select at least one selected from the group consisting of ethanol, ethylene glycol, propylene glycol, glycerol, ethylene glycol monobutyl ether, 2-phenoxyethanol and benzyl alcohol.

The content of the component (C) in the liquid detergent composition according to the present invention is, from the viewpoint of suppressing the crystal deposition at low temperatures of the component (A), preferably 0.1% by mass or more, more preferably 1% by mass or more, and even more preferably 5% by mass or more. Then, the content is preferably 50% by mass or less, more preferably 30% by mass or less, and even more preferably 20% by mass or less. The specific range of the content of the component (C) is preferably from 0.1 to 50% by mass, more preferably from 1 to 30% by mass, and even more preferably from 5 to 20% by mass.

Further from the viewpoint of suppressing the crystal deposition at low temperatures, the mass ratio of the component (A) to a total amount of the component (B) and the component (C), (A/(B+C)), is 0.6 or more and 5 or less, more preferably 0.6 or more and 4 or less, and even more preferably 0.6 or more and 3 or less. The specific range of the (A/(B+C)) is from 0.6 to 5, preferably from 0.6 to 4, more preferably from 0.6 to 3, and even more preferably from 1.2 to 2.5.

Further from the viewpoint of suppressing the crystal deposition at low temperatures of the component (A), the mass ratio of the component (B) to the component (C), (B/C), is preferably 0.05 or more, more preferably 0.1 or more, more preferably 0.15 or more, even more preferably 0.2 or more, and further preferably 0.25 or more, and then preferably 1.8 or less and more preferably 1.5 or less. The specific range of the (B/C) is preferably from 0.05 to 1.8, more preferably from 0.1 to 1.8, and even more preferably from 0.15 to 1.5.

[Component (D)]

The liquid detergent composition according to the present invention, in order to make its state at 4° C. to 40° C. to be a liquid state, comprises the component (D), water. As the water, there can be used deionized water (called ion-exchange water in some cases) or water in which sodium hypochlorite is added in 1 mg/kg or more and 5 mg/kg or less to ion-exchange water. Tap water can also be used.

The content of water can be the balance of the components (A) to (C), or the balance of the components (A) to (C) and other optional components.

[Component (E)]

The liquid detergent composition according to the present invention, in order to improve low-temperature stability, can further comprise a component (E), a nonionic surfactant. The nonionic surfactant includes, from the viewpoint of the detergency and the improvement of the low-temperature stability of the liquid detergent composition, polyethylene glycol-type nonionic surfactants such as polyoxyethylene sorbitan fatty acid esters, polyoxyethylene sorbit fatty acid esters, polyoxyethylene glycerine fatty acid esters, polyoxyethylene fatty acid esters, polyoxyethylene alkyl ethers, polyoxyethylene alkyl phenyl ethers and polyoxyalkylene (hydrogenated) castor oils, polyhydric alcohol-type nonionic surfactants such as sucrose fatty acid esters, polyglycerine alkyl ethers, polyglycerine fatty acid esters and alkyl glycosides, and fatty acid alkanolamides.

Among these, incorporation of at least one nonionic surfactant selected from the group consisting of (e1) represented by the following formula (2) and (e2) represented by the following formula (3) is preferable from the viewpoint of suppressing the crystal deposition at low temperatures.

$$(e1):R^2(XO)_nH \quad (2)$$

wherein $R^2$ represents a hydrocarbon group having 10 or more and 18 or less carbon atoms; XO represents an ethyleneoxy group or a propyleneoxy group; and m represents an average number of moles added and is the number of 4 or more and 10 or less.

$$(e2):R^3(OR^4)_wG_y \quad (3)$$

wherein $R^3$ represents a hydrocarbon group having 8 to 18 carbon atoms; $R^4$ represents an alkylene group having 2 to 4 carbon atoms; G represents a residue originated from a reducing sugar having 5 to 6 carbon atoms; w represents an average number of moles added of 0 to 5, and y represents an average number of moles added of 1 to 10.

$R^2$ in (e1) is, from the viewpoint of suppressing the crystal deposition at low temperatures, preferably a hydrocarbon group having 10 or more and 14 or less carbon atoms, and more preferably a hydrocarbon group having 12 carbon atoms. XO is, from the viewpoint of the dissolvability to water, preferably an ethyleneoxy group. The average number of moles added of m is, from the viewpoint of suppressing the crystallization at low temperatures, preferably from 5 to 8.

$R^3$ in (e2) is, from the viewpoint of suppressing the crystal deposition at low temperatures, preferably a hydrocarbon group having 10 or more and 14 or less carbon atoms, and more preferably a hydrocarbon group having 12 carbon atoms. The average number of moles added of w is, from the viewpoint of suppressing the crystal deposition, preferably 0 to 3, and more preferably 0. The average number of moles added of y is preferably from 1 to 5, and more preferably from 1 to 2.

The content of the component (E) in the liquid detergent composition according to the present invention is, from the viewpoint of the detergency and the suppression of the crystal deposition at low temperatures, preferably 0.1% by mass or more and 40% by mass or less, more preferably 0.5% by mass or more, and even more preferably 1.0% by mass or more. Further the content is preferably 30% by mass or less, and more preferably 20% by mass or less. The specific range of the content of the component (E) is preferably from 0.1 to 40% by mass, more preferably from 0.5 to 30% by mass, and even more preferably from 1.0 to 20% by mass.

The mass ratio of the component (B) to the component (E), (B/E), is, from the point of improving the flowability of the liquid detergent composition according to the present invention, preferably 0.1 or more and more preferably 0.2 or more, and then preferably 2.0 or less and more preferably 1.5 or less. The specific range of the (B/E) is preferably from 0.1 to 2, and more preferably from 0.2 to 1.5.

The liquid detergent composition according to the present invention may comprise a surfactant component (F), other than the components (A), (B) and (E).

The component (F) includes anionic surfactants. The component (F) includes alkylbenzenesulfonic acids having an aliphatic alkyl group having 8 or more and 22 or less carbon atoms, alkanesulfonic acids having an alkane having 8 or more and 20 or less carbon atoms, alkylsulfate esters and polyoxyalkylene alkyl ether sulfate esters having an aliphatic alkyl group having 8 or more and 22 or less carbon atoms, and salts thereof. Preferable components (F1) are alkylbenzenesulfonic acids having an aliphatic alkyl group having 12 or more and 16 or less carbon atoms, and salts thereof. The salts of the component (F) include alkali metal salts, alkaline earth metal salts, ammonium salts and alkanolamine salts having 1 or more and 6 or less carbon atoms. The salt is preferably one or more selected from the group consisting of sodium salts, potassium salts, monoethanolammonium salts and triethanolammonium salts.

The component (F) may also comprise an amphoteric surfactant. Examples of the amphoteric surfactant include sulfobetaines and carbobetaines having an alkyl group having 10 or more and 18 or less carbon atoms.

The content of the component (F) in the liquid detergent composition according to the present invention is, preferably 0.5% by mass or more and 15% by mass or less, and more preferably 0.5% by mass or more and 10% by mass or less. Then, with respect to a quaternary ammonium salt, the mass thereof subtracted by the counter anion is regarded as a mass of the quaternary ammonium salt; and with respect to a tertiary amine, the mass of a structure in which groups excluding organic groups out of groups bound to the nitrogen atom are substituted by hydrogen atoms is regarded as a mass of the tertiary amine.

Incorporation of an alkali agent (hereinafter, called component (G)) to the liquid detergent composition according to the present invention is preferable from the point of the detergency. The alkali agent includes alkali metal hydroxides, alkali metal carbonate salts, and additionally alkanolamines in which 1 or more and 3 or less groups out of groups bound to the nitrogen atom are alkanol groups having 2 or more and 4 or less carbon atoms, and the rest groups thereof are alkyl groups having 1 or more and 4 or less carbon atoms or hydrogen atoms. Among these, the alkanol group is preferably a hydroxyalkyl group, particularly a hydroxyethyl group. The groups other than the alkanol group are preferably hydrogen atoms or methyl groups, and especially preferably hydrogen atoms. The alkanolamine includes monoethanolamine, N-methylethanolamine, N,N-dimethylethanolamine, N,N-diethylethanolamine, diethanolamine, N-methyldiethanolamine and triethanolamine. In the present invention, the component (G) is preferably an alkanolamine selected from the group consisting of monoethanolamine and triethanolamine, and is more preferably monoethanolamine.

Further the alkali agent as the component (G) can also be used in order to regulate the pH of the liquid detergent composition according to the present invention at a predetermined pH.

The liquid detergent composition according to the present invention may comprise the component (G) in such an amount that the pH described later is attained. Specifically, the component (G) may be contained in 0.01% by mass or more and further 0.5% by mass or more, and then 10% by mass or less and further 8% by mass or less. It is preferable that particularly an alkanolamine as the component (G) be contained in 0.5% by mass or more, further 1% by mass or more and further 3% by mass or more, and then 8% by mass or less, further 7% by mass or less and further 6% by mass or less. Here, in the present invention, in the content of an alkali agent, particularly an alkanolamine as the component (G), those originating from other components and contained in the composition, such as counter ions of the component (A) and the component (B), are counted.

The liquid detergent composition according to the present invention may comprise a chelating agent (hereinafter, called component (H)). Specific examples of the chelating agent as the component (H) include aminopolyacetic acids such as ethylenediaminetetraacetic acid, diethylenetriaminepentaacetic acid and hydroxyethyliminodiacetic acid, and salts thereof, organic acids such as citric acid, lactic acid, tartaric acid and malic acid, and salts thereof, 1-hydroxyethylidene-1,1-diphosphonic acid and diethylenetriaminepenta(methylenephosphonic acid), and alkali metal salts thereof or lower amine salts thereof. The content of the component (H) is, in the case of regarding it as an acid, 0.1% by mass or more and 5% by mass or less, preferably 0.1% by mass or more and 4% by mass or less, and even more preferably 0.1% by mass or more and 3% by mass or less.

Additionally, the liquid detergent composition according to the present invention may comprise the following components (i1) to (i6).

(i1) 0.01% by mass or more and 10% by mass or less of an anti-refouling agent and a dispersant such as polyacrylic acid, polymaleic acid and carboxymethylcellulose (i2) 0.01% by mass or more and 10% by mass or less of a bleaching agent such as hydrogen peroxide, sodium percarbonate or sodium perborate (i3) 0.01% by mass or more and 10% by mass or less of a bleach activator such as tetraacetylethylenediamine or bleach activators represented by the formulae (I-2) to (I-7) in JP-A-H06-316700

(i4) One enzyme selected from the group consisting of protease, metalloprotease, keratinase, hemicellulase, cellulase, pectinase, pectic acid lyase, mannanase, amylase, pectate lyase, perhydrolase, peroxidase, xylanase, lipase, phospholipase, esterase, cutinase, reductase, oxidase, phenol oxidase, lipoxygenase, ligninase, pullulanase, tannase, pentosanase, malanase, β-glucanase, arabinosidase, hyaluronidase, chondroitinase, laccase and xyloglucanase, or a mixture in an optional combination thereof. Among these, preferable are protease, cellulase, pectinase, mannanase, amylase, lipase and xyloglucanase, and more preferable are protease, cellulase and lipase. Use of these in a combination of 7 kinds or 3 kinds thereof is preferable from the viewpoint of providing higher detergency. It is preferable that these enzymes be contained, in the composition, in from 0.00001% by mass to 2% by mass, preferably from 0.0001% by mass to 1% by mass, and more preferably from 0.001% by mass to 0.5% by mass.

(i5) 0.01% by mass or more and 2% by mass or less of an antioxidant such as butylhydroxytoluene, di-styrenated cresol, sodium sulfite or sodium hydrogensulfite (i6) Proper amounts of a coloring matter, a perfume, an antibacterial antiseptic agent and a defoaming agent such as a silicone.

The pH at 20° C. of the liquid detergent composition according to the present invention is, from the point of providing excellent cleaning performance, preferably, 4 or more, further 6 or more, further 6.5 or higher and further 7 or more, and then, preferably, 11 or less, further 9 or less and further 8 or less. The pH is measured by a method JIS K3362:1998, Section 8.3, and the temperature at this time is 20° C. described therein. From the point of the cleaning performance and the ease of handling of the liquid detergent composition according to the present invention, the pH measured by the above method is preferably 6 or more and 13 or less, and more preferably 6.5 or more and 8 or less.

The liquid detergent according to the present invention can be used for liquid detergents for clothes, liquid detergents for hard surfaces (ceramics, glasses, resins and the like), shampoos, body shampoos and the like; use for liquid detergents for clothes and liquid detergents for hard surfaces is preferable, and use for liquid detergents for clothes is more preferable.

[Method for Cleaning Clothes]

The present invention provides a method for cleaning clothes comprising cleaning clothes by using a cleaning solution comprising water and 0.01% by mass or more and 0.1% by mass or less of the liquid detergent composition according to the present invention and having a temperature of 0° C. or more and 35° C. or less under the condition that the bath ratio represented by a ratio of a volume (L) of the cleaning solution to a mass of the clothes is a volume (L) of the cleaning solution/a mass (kg) of the clothes=3 or more and 50 or less.

It is preferable that the cleaning solution comprise the liquid detergent composition according to the present invention in 0.01% by mass or more and further 0.02% by mass or more, and then, 0.2% by mass or less and further 0.1% by mass or less. Further it is preferable that the cleaning solution comprise the component (A) and the component (B) in a total amount of 0.006% by mass or more and further 0.01% by mass or more, and then, 0.08% by mass or less and further 0.07% by mass or less.

Water for preparing the cleaning solution may be any water. Examples thereof include tap water, ion-exchange water, well water and river water. The hardness of the water suitable for cleaning includes 1° DH or more and 200 DH or less in terms of Germany hardness.

The temperature of the cleaning solution is, from the point of improving the cleaning speed, preferably 0° C. or higher, more preferably 3° C. or more, and even more preferably 5° C. or more. The temperature is, from the point of not removing too much of oils contained in fibers themselves constituting the clothes and maintaining feeling of the fibers, preferably 35° C. or less, more preferably 30° C. or less, even more preferably 15° C. or less, and further preferably 10° C. or less. Then in cleaning during the wintertime, even when clothes are cleaned at a temperature of the cleaning solution as low as more than 0° C. and 10° C. or less, further, more than 3° C. and 8° C. or less, there can be carried out the cleaning method high in the cleaning speed of sebum stains and excellent in the detergency to spilled food stains.

In recent years, washing machines are upsized and then, the value of a bath ratio represented by a ratio of a water volume (L) of a cleaning solution to a mass of clothes, that is, a water volume (L) of a cleaning solution/a mass (kg) of clothes (hereinafter, this ratio is taken as a bath ratio in some cases) is likely to become low. In the case of using household washing machines, it is said that when the bath ratio becomes low, it becomes difficult for the mechanical force by stirring to be transmitted to clothes to reduce the detergency. The method for cleaning clothes according to the present invention can improve the cleaning speed even under the cleaning condition of a low bath ratio. The bath ratio is, from the point of the detergency, preferably 4 or more, and more preferably 5 or more. The bath ratio is, from the point of providing a larger effect of improving the cleaning speed, preferably 45 or less, more preferably 40 or less, even more preferably 30 or less, further preferably 20 or less, and further preferably 15 or less.

The method for cleaning clothes according to the present invention can attain the more advantage of the present invention on objects on which a mechanical force is not uniformly exerted, like clothes constituted of fibers to consumers' applications, than the methods of dipping fibers in a solution to be used for scouring while the fibers are conveyed by a roller or the like, like scouring methods of fibers. Further the cleaning method according to the present invention is suitable in a rotary cleaning method. The rotary cleaning method means a cleaning method in which clothes not being fixed on a rotary device are rotated around a rotating shaft together with a cleaning solution. The rotary cleaning method can be carried out by using a rotary washing machine. Therefore, in the present invention, it is preferable that cleaning of clothes be carried out by using rotary washing machines. As these rotary washing machines, there can be used household ones commercially available.

The preferable method for cleaning clothes according to the present invention, in terms of actual feeling of the improvement of the cleaning speed and the detergency of spilled food stains, is a rotary cleaning method using a rotary washing machine, in which water, clothes and the liquid detergent composition for clothes according to the present invention to be used for cleaning are stirred in a rotary washing machine. The rotary washing machine is preferably a drum-type fully automatic washing machine, a pulsator-type fully automatic washing machine or an agitator-type fully automatic washing machine, more preferably a pulsator-type fully automatic washing machine or an agitator-type fully automatic washing machine, and even more preferably a pulsator-type fully automatic washing machine. The cleaning method involves carrying out cleaning at a value of the bath ratio represented by a ratio of a mass (kg) of clothes to a volume (L) of a cleaning solution in which water and the liquid detergent composition to be used for cleaning are mixed, that is, at a value of a mass (kg) of clothes/a volume (L) of the liquid detergent composition of preferably 5 or more, and more preferably 10 or more, and then, preferably 20 or less and more preferably 15 or less; the cleaning method involves carrying out cleaning at a temperature of the cleaning solution of more than 0° C. and preferably more than 3° C., and then, preferably 15° C. or less and more preferably 10° C. or less; and the cleaning method involves the time, from the start of stirring water, clothes and the liquid detergent composition to be used for cleaning until start of discharging the cleaning solution from a washing machine, of preferably 1 min or longer, more preferably 2 min or longer and even more preferably 3 min or longer, and then, preferably 7 min or shorter, more preferably 6 min or shorter and even more preferably 5 min or shorter.

Therefore, the method for cleaning clothes according to the present invention includes a method for cleaning clothes in which cleaning is carried out by using a cleaning solution comprising water and 0.01% by mass or more and 0.1% by mass or less of the liquid detergent composition according to the present invention, and having a temperature of more than 0° C., preferably more than 3° C. and then, 15° C. or less, preferably 10° C. or less, under the condition of the bath ratio represented by a ratio of the volume (L) of the cleaning solution to a mass of clothes, that is, a ratio of a volume (L) of the cleaning solution/a mass (kg) of clothes=5 or more, preferably 10 or more and then, 20 or less, preferably 15 or less, for 1 min or longer, preferably 2 min or longer, more preferably 3 min or longer and then, 7 min or shorter, preferably 6 min or shorter, even more preferably 5 min or shorter by a rotary washing machine, preferably a drum-type fully automatic washing machine, a pulsator-type fully automatic washing machine or an agitator-type fully automatic washing machine, more preferably a pulsator-type fully automatic washing machine or an agitator-type fully automatic washing machine, even more preferably a pulsator-type fully automatic washing machine. As these rotary washing machines, there can be used household ones commercially available.

With respect to the above-mentioned embodiment, the present invention further discloses the following liquid detergent compositions and methods for cleaning clothes.

<1> A liquid detergent composition comprising the following components (A) to (D), wherein the mass ratio of the component (A) to a total amount of the component (B) and the component (C), (A/(B+C)), is 0.6 or more and 5 or less; and the mass ratio of the component (B) to the component (C), (B/C), is 0.05 or more and 1.8 or less:

(A): 10 to 40% by mass of an internal olefin sulfonate salt having 16 or more and 18 or less carbon atoms in which a content of an internal olefin sulfonate salt having a sulfonic group at the C-2 position is 5% by mass or more and 25% by mass or less;

(B): 0.5 to 16% by mass of a fatty acid salt represented by the following formula (1)

$$R^1COOM \quad (1)$$

wherein $R^1$ represents an alkyl group or alkenyl group having 10 or more and 14 or less carbon atoms; and M represents a hydrogen atom, an alkali metal, alkaline earth metal (½ atom), ammonium or an organic ammonium, (C): an organic solvent having one or more hydroxyl groups (D): water.

<2> The liquid detergent composition according to <1>, wherein the content of the internal olefin sulfonate salt having a sulfonic group at the C-2 position in the component (A) is preferably from 6 to 23% by mass, more preferably from 7 to 20% by mass, even more preferably from 8 to 20% by mass, further preferably from 9 to 20% by mass, further preferably from 10 to 20% by mass, further preferably from 12 to 20% by mass, further preferably from 14 to 20% by mass, and further preferably from 16 to 20% by mass.

<3> The liquid detergent composition according to <1> or <2>, wherein the component (A) is an internal olefin sulfonate salt having 16 carbon atoms, an internal olefin sulfonate salt having 18 carbon atoms, or a mixture of an internal olefin sulfonate salt having 16 carbon atoms and an internal olefin sulfonate salt having 18 carbon atoms.

<4> The liquid detergent composition according to any one of <1> to <3>, wherein the mass ratio of a content of an internal olefin sulfonate salt having 16 carbon atoms to a content of an internal olefin sulfonate salt having 18 carbon atoms (an internal olefin sulfonate salt having 16 carbon atoms/an internal olefin sulfonate salt having 18 carbon atoms) in the component (A) is preferably from 50/50 to 99/1, more preferably from 60/40 to 95/5, even more preferably from 70/30 to 90/10, further preferably from 75/25 to 90/10, and further preferably from 75/25 to 85/15.

<5> The liquid detergent composition according to any one of <1> to <4>, wherein the mass ratio of a content of the hydroxy form to a content of the olefin form (hydroxy form/olefin form) in the internal olefin sulfonate salt in the component (A) is preferably from 50/50 to 100/0, more preferably from 60/40 to 100/0, even more preferably from 70/30 to 100/0, further preferably from 75/25 to 100/0, and further preferably from 75/25 to 95/5.

<6> The liquid detergent composition according to any one of <1> to <5>, wherein the content of the component (A) is preferably from 10 to 35% by mass, and more preferably from 10 to 30% by mass.

<7> The liquid detergent composition according to any one of <1> to <6>, wherein M in the formula (1) is preferably an alkali metal, ammonium or an organic ammonium, more preferably an alkali metal or an organic ammonium, even more preferably an organic ammonium, and further preferably an alkanolamine.

<8> The liquid detergent composition according to any one of <1> to <7>, wherein the content of the component (B) is, in terms of acid, preferably 0.5% by mass or more and more preferably 1.0% by mass or more, and then, preferably 16% by mass or less, more preferably 15% by mass or less, even more preferably 10% by mass or less, further preferably 8% by mass or less, and further preferably 7% by mass or less.

<9> The liquid detergent composition according to any one of <1> to <7>, wherein the content of the component (B) is preferably from 0.5 to 15% by mass, more preferably from 0.5 to 10% by mass, even more preferably from 1 to 8% by mass, and further preferably from 1 to 7% by mass.

<10> The liquid detergent composition according to any one of <1> to <9>, wherein the component (C) is at least one selected from the group consisting of monohydric alcohols, polyhydric alcohols and polyhydric alcohol ethers.

<11> The liquid detergent composition according to any one of <1> to <10>, wherein the component (C) comprises at least one selected from the group consisting of the following components (c1) to (c6):

(c1): Monohydric alcohols having an aliphatic hydrocarbon group having 2 or more and 6 or less carbon atoms (c2): Di- or more hydric and hexa- or less hydric alcohols having 2 or more and 6 or less carbon atoms (excluding component (c3))

(c3): Polyalkylene glycols comprising an alkylene glycol unit having 2 or more and 4 or less carbon atoms (c4): Monoalkyl ethers of (mono or poly)alkylene glycols, having an alkylene glycol unit having 2 or more and 4 or less carbon atoms and an alkyl group having 1 or more and 4 or less carbon atoms (c5): Alkyl glyceryl ethers having alkyl having 1 or more and 8 or less carbon atoms (c6): Aromatic compounds having an alcoholic hydroxyl group.

<12> The liquid detergent composition according to any one of <1> to <11>, wherein the content of the component (C) is preferably 0.1% by mass or more, more preferably 1% by mass or more and even more preferably 5% by mass or more and then, preferably 50% by mass or less.

<13> The liquid detergent composition according to any one of <1> to <12>, wherein the B/C is preferably 0.2 or more and more preferably 0.25 or more, and then, preferably 3 or less and more preferably 1.5 or less.

<14> The liquid detergent composition according to any one of <1> to <13>, wherein the A/(B+C) is preferably from 0.1 to 1.8 and more preferably from 0.15 to 1.5.

<15> The liquid detergent composition according to any one of <1> to <14>, further comprising 0.1% by mass or more and 40% by mass or less of a nonionic surfactant as a component (E).

<16> The liquid detergent composition according to <15>, wherein the nonionic surfactant as the component (E) is at least one selected from the group consisting of (e1) represented by the following formula (2) and (e2) represented by the following formula (3):

$$(e1):R^2O(XO)_mH \quad (2)$$

wherein $R^2$ represents a hydrocarbon group having 10 or more and 18 or less carbon atoms; XO represents an ethyleneoxy group or a propyleneoxy group; and m represents an average number of moles added and is the number of 4 or more and 10 or less;

$$(e2):R^3(OR^4)_wG_y \quad (3)$$

wherein $R^3$ represents a hydrocarbon group having 8 to 18 carbon atoms; $R^4$ represents an alkylene group having 2 to 4 carbon atoms; G represents a residue originated from a reducing sugar having 5 to 6 carbon atoms; w represents an average number of moles added of 0 to 5, and y represents an average number of moles added of 1 to 10.

<17> The liquid detergent composition according to <16>, wherein $R^2$ in (e1) is a hydrocarbon group having 10 or more and 14 or less carbon atoms.

<18> The liquid detergent composition according to <16>, wherein $R^3$ in (e2) is a hydrocarbon group having 10 or more and 14 or less carbon atoms.

<19> The liquid detergent composition according to any one of <15> to <18>, wherein the content of the component (E) is 0.1% by mass or more and 40% by mass or less, preferably 0.5% by mass or more and 30% by mass or less, and more preferably 1.0% by mass or more and 20% by mass or less.

<20> The liquid detergent composition according to any one of <15> to <19>, wherein the mass ratio of the component (B) to the component (E), (B/E), is preferably from 0.1 to 2, and more preferably from 0.1 to 1.5.

<21> The liquid detergent composition according to any one of <1> to <20>, further comprising, as a component (F), one or more selected from the group consisting of alkylbenzenesulfonic acids having an aliphatic alkyl group having 8 or more and 22 or less carbon atoms, alkanesulfonic acids having an alkane having 8 or more and 20 or less carbon atoms, alkylsulfate esters and polyoxyalkylene alkyl ether sulfate esters having an aliphatic alkyl group having 8 or more and 22 or less carbon atoms, and salts thereof, preferably comprising an alkylbenzenesulfonic acid having an aliphatic alkyl group having 12 or more and 16 or less carbon atoms, or salts thereof.

<22> The liquid detergent composition according to <21>, wherein the content of the component (F) is 0.5% by mass or more and 15% by mass or less, preferably 0.5% by mass or more and 10% by mass or less.

<23> The liquid detergent composition according to any one of <1> to <22>, further comprising a component selected from the group consisting of alkali agents and chelating agents.

<24> A method for cleaning clothes, comprising cleaning clothes by using a cleaning solution having a temperature of 0° C. or more and 35° C. or less comprising water and 0.01% by mass or more and 0.1% by mass or less of the liquid detergent composition according to any one of <1> to <23> under the condition that the bath ratio represented by a ratio of a volume (L) of the cleaning solution to a mass of the clothes, a volume (L) of the cleaning solution/a mass (kg) of the clothes, is 3 or more and 50 or less.

<25> The method for cleaning clothes according to <24>, wherein the cleaning of clothes is carried out by using a rotary washing machine.

EXAMPLES

Hereinafter, the present invention will be described specifically based on Examples. Here, in the following Examples and Comparative Examples, unless otherwise specified, "parts" means "parts by mass", and "%" means "% by mass". Then, measurement methods of various physical properties were as follows.

(1) Measurement Conditions (i) Measurement Method of the Position of the Double Bond of an Internal Olefin as a Raw Material The position of the double bond of an internal olefin as a raw material was measured by gas chromatography (hereinafter, abbreviated to GC). Specifically, by reacting the internal olefin with dimethyl disulfide, the internal olefin was converted to a dithiolated derivative, and thereafter, each component was separated by GC. As a result, the position of the double bond of the internal olefin was determined from each peak area.

Here, an apparatus and the analysis condition used for the measurement were as follows. A GC apparatus (trade name: HP6890, manufactured by Hewlett-Packard Development Co.), a column (trade name: Ultra-Alloy-1HT Capillary Column 30 m×250 μm×0.15 μm, manufactured by Frontier Laboratories Ltd.), a detector (flame ionization detector (FID)), the injection temperature: 300° C., the detector temperature: 350° C., the He flow volume: 4.6 mL/min (ii) Measurement Method of the Content of an Internal Olefin Sulfonate Salt Having a Sulfonic Group at the C-2 Position The binding position of the sulfonic group was measured by GC. Specifically, by reacting an internal olefin sulfonate salt with trimethylsilyldiazomethane, the internal olefin sulfonate salt was converted to a methyl-esterified derivative, and thereafter, each component was separated by GC. The ratio of each peak area was taken as each mass ratio and the content of the internal olefin sulfonate salt having a sulfonic group at the C-2 position was calculated. Here, an apparatus and the analysis condition used for the measurement were as follows. A GC apparatus (trade name: Agilent Technology 6850, manufactured by Agilent Technologies, Inc.), a column (trade name: HP-1 Capillary Column 30 m×320 m×0.25 m, manufactured by Agilent Technologies, Inc.), a detector (flame ionization detector (FID)), the injection temperature: 300° C., the detector temperature: 300° C., the He flow volume: 1.0 mL/min, an oven (60° C. (0 min)→10° C./min→300° C. (10 min))

(iii) Measurement Method of the Mass Ratio of a Hydroxy Form/an Olefin Form

The mass ratio of a hydroxy form/an olefin form of an internal olefin sulfonate salt was measured by HPLC-MS. Specifically, the hydroxy form and the olefin form were separated by HPLC, and the each was subjected to MS to thereby identify the both. As a result, each proportion was determined from each HPLC-MS peak area.

An apparatus and the condition used for the measurement were as follows. An HPLC apparatus (trade name: Agilent Technology 1100, manufactured by Agilent Technologies, Inc.), a column (trade name: L-columnODS4.6×150 mm, manufactured by Chemicals Evaluation and Research Institute, Japan), the sample preparation (diluted 1,000 times with methanol), an eluate A (10 mM ammonium acetate-added water), an eluate B (10 mM ammonium acetate-added methanol), the gradient (0 min (A/B=30/70%)→10 min (30/70%)→55 min (0/100%)→65 min (0/100%)→66 min (30/70%)→75 min (30/70%)), an MS apparatus (trade name: Agilent Technology 1100MS SL(G1946D)), the MS detection (negative ion detection m/z: 60-1,600, UV240 nm)

Production Example A 7,000 g (28.9 mol) of 1-hexadecanol (product name: Kalcol 6098, manufactured by Kao Corp.), and 700 g (10% by weight to the raw material alcohol) of γ-alumina (manufactured by STREMChemicals, Inc.) as a solid acid catalyst were charged in a flask with a stirrer, and allowed to react for 3 or longer hours under stirring while nitrogen (7,000 mL/min) was circulated in the system at 280° C. After the finish of the reaction, the alcohol conversion rate was 100% and a C16 internal olefin purity was 99.6%. The obtained crude internal olefin was transferred to a distillation flask and distilled at 136 to 160° C./4.0 mmHg to thereby obtain an internal olefin having an olefin purity of 100% and having 16 carbon atoms. The double bond distribution of the obtained internal olefin was: 1.8% by mass at the C-1 position; 30.2% by mass at the C-2 position; 25.1% by mass at the C-3 position; 17.9% by mass at the C-4 position; 12.3% by mass at the C-5 position; 6.6% by mass at the C-6 position; and 6.0% by mass in total at the C-7 and C-8 positions.

Production Example B 7,000 g (25.9 mol) of 1-octadecanol (product name: Kalcol 8098, manufactured by Kao Corp.), and 700 g (10% by weight to the raw material alcohol) of γ-alumina (manufactured by STREMChemicals, Inc.) as a solid acid catalyst were charged in a flask with a stirrer, and allowed to react for 10 or longer hours under stirring while nitrogen (7,000 mL/min) was circulated in the system at 280° C. After the finish of the reaction, the alcohol conversion rate was 100% and a C18 internal olefin purity was 98.2%. The obtained crude internal olefin was transferred to a distillation flask and distilled at 148 to 158° C./0.5 mmHg to thereby obtain an internal olefin having an olefin purity of 100% and having 18 carbon atoms. The double bond distribution of the obtained internal olefin was: 1.4% by mass at the C-1 position; 31.0% by mass at the C-2 position; 25.5% by mass at the C-3 position; 18.1% by mass at the C-4 position; 10.7% by mass at the C-5 position; 6.4% by mass at the C-6 position; 3.6% by mass at the C-7 position; and 3.2% by mass in total at the C-8 and C-9 positions.

Production Example C 11.9 kg of the internal olefin having 16 carbon atoms obtained in Production Example A and 3.1 kg of the internal olefin having 18 carbon atoms obtained in Production Example B were mixed to thereby obtain 15.0 kg of an internal olefin having 16/18 carbon atoms (mass ratio: 79.4/20.6). The double bond distribution of the internal olefin was: 1.8% by mass at the C-1 position; 30.4% by mass at the C-2 position; 25.2% by mass at the C-3 position; 18.0% by mass at the C-4 position; 12.0% by mass at the C-5 position; 6.6% by mass at the C-6 position; 3.1% by mass at the C-7 position; 2.7% by mass at the C-8 position; and 1.6% by mass at the C-9 position.

Production Example 1

The internal olefin (the content of the internal olefin having a double bond at the C-2 position was 25.2% by mass) having 16/18 carbon atoms produced in Production Example C was subjected to a sulfonation reaction by using a thin membrane-type sulfonation reactor having a jacket on the outside and by feeding sulfur trioxide gas to the reactor and passing cooling water at 20° C. through the jacket outside the reactor. The molar ratio of the SO3/the internal olefin in the sulfonation reaction was set at 1.05. An obtained sulfonated material was added to an alkali aqueous solution prepared by using sodium hydroxide in an amount 1.1 mol times the theoretical acid value and neutralized under stirring at 30° C. for 1 hour. A neutralized material was heated in an autoclave at 160° C. for 1 hour for hydrolysis; and a water phase side was evaporated to dryness to thereby obtain a sodium internal olefin sulfonate having 16/18 carbon atoms (A1). The mass ratio of a hydroxy form (sodium hydroxyalkane sulfonate)/an olefin form (sodium olefin sulfonate) in the obtained sodium internal olefin sulfonate was 86/14. Then the content of the internal olefin as the raw material comprised in the obtained sodium internal olefin sulfonate was 2.0% by mass, and inorganic compounds was 1.7% by mass. Further the content of the internal olefin sulfonate salt having a sulfonic group present at C-2 position was 19.8% by mass.

Method for Producing an Internal Olefin Sulfonate Salt (A2) (C16IOS)

An internal olefin sulfonate salt having 16 carbon atoms (A2) was obtained under the same condition as in Production Example 1, except for using the internal olefin having 16 carbon atoms produced in Production Example A. The mass ratio of a hydroxy form (sodium hydroxyalkane sulfonate)/an olefin form (sodium olefin sulfonate) in the obtained sodium internal olefin sulfonate was 84/16. Then the content of the internal olefin as the raw material comprised in the obtained sodium internal olefin sulfonate was 2.2% by mass, and inorganic compounds was 2.0% by mass. Further the content of the internal olefin sulfonate salt having a sulfonic group at the C-2 position was 15.0% by mass.

Method for Producing an Internal Olefin Sulfonate Salt (A3) (C18IOS)

An internal olefin sulfonate salt having 18 carbon atoms (A3) was obtained under the same condition as in Production Example 1, except for using the internal olefin having 18 carbon atoms produced in Production Example B. The mass ratio of a hydroxy form (sodium hydroxyalkane sulfonate)/an olefin form (sodium olefin sulfonate) in the obtained sodium internal olefin sulfonate was 80/20. Then the content of the internal olefin as the raw material comprised in the obtained sodium internal olefin sulfonate was 4.2% by mass, and inorganic compounds was 2.0% by mass. Further the content of the internal olefin sulfonate salt having a sulfonic group at the C-2 position was 16.0% by mass.

[Preparation of Liquid Detergent Compositions]

By using an internal olefin sulfonate salt indicated in Table 1, liquid detergent compositions for clothes having compositions indicated in Table 2 and Table 3 were prepared by the following method. The component A was charged in a beaker, and as the case may be, a nonionic surfactant as the component E was further added. Then, the components C and D were added, and fully stirred and made homogeneous; thereafter, a part of the neutralizing agent as the component (B) was added and citric acid was then added and made homogeneous. Thereafter, the rest of the neutralizing agent was added to regulate the pH at 7.8 to 13.0 to thereby obtain each detergent composition.

The obtained each composition was transferred to a glass container, and stored in a thermostat chamber at −5° C. for 1 day; and the appearance of the solution after the storing was visually checked. The presence/absence of deposition of the surfactant was judged from the appearance.

TABLE 1

| | Number of Carbon Atoms | HAS/IOS | Proportion of an Internal Olefin sulfonate Salt having a Sulfonic Acid Group at the C-2 Position |
|---|---|---|---|
| internal olefin sulfonate salt (A1) | C16/C18(8/2) | 86/14 | 19.80% |
| internal olefin sulfonate salt (A2) | C16 | 86/14 | 15.00% |
| internal olefin sulfonate salt (A3) | C18 | 80/20 | 16.00% |

TABLE 2

| | | Example | | | | | | | | | | | |
|---|---|---|---|---|---|---|---|---|---|---|---|---|---|
| | Blend Composition | 1 | 2 | 3 | 4 | 5 | 6 | 7 | 8 | 9 | 10 | 11 | 12 |
| A | internal olefin sulfonate sodium salt*1 | 18 | 18 | 18 | 18 | 18 | 18 | 18 | 21 | 18 | 13 | 21 | 18 |
| B | palm fatty acid*2 | 5 | 4 | 6 | 6 | 8 | 8 | 10 | 2 | 5 | 10 | 2 | 5 |
| C | ethylene glycol monobutyl ether*3 | 10 | 8 | 12 | 12 | 16 | 16 | 20 | 10 | 10 | 10 | 10 | 10 |
| E | polyoxyethylene(6) lauryl ether*4 | — | — | — | — | — | — | — | 10 | 10 | 10 | — | — |
| | lauryl glucoside*5 | — | — | — | — | — | — | — | — | — | — | 10 | 10 |
| | citric acid | — | 2 | 2 | 2 | 2 | 2 | 2 | 2 | 2 | 2 | 2 | 2 |
| | monoethanolamine | q.s. | q.s. | q.s. | — | q.s. | — | q.s. | q.s. | q.s. | q.s. | q.s. | q.s. |
| | sodium hydroxide | — | — | — | q.s. | — | q.s. | — | — | — | — | — | — |
| D | water | balance | | | | | | | | | | | |
| | Total | 100 | 100 | 100 | 100 | 100 | 100 | 100 | 100 | 100 | 100 | 100 | 100 |
| | pH | 8 | 8 | 8 | 12.8 | 8 | 13 | 7.9 | 8.5 | 8.1 | 8 | 7.7 | 7.8 |
| | A/(B + C) | 1.2 | 1.5 | 1 | 1 | 0.75 | 0.75 | 0.6 | 1.75 | 1.2 | 0.65 | 1.75 | 1.2 |
| | B/C | 0.5 | 0.5 | 0.5 | 0.5 | 0.5 | 0.5 | 0.5 | 0.2 | 0.5 | 1 | 0.2 | 0.5 |
| | B/E | — | — | — | — | — | — | — | 0.2 | 0.5 | 1 | 0.2 | 0.5 |

TABLE 2-continued

| | | | | | | | | | | | | | |
|---|---|---|---|---|---|---|---|---|---|---|---|---|---|
| presence/absence of deposition | | absent | absent | absent | absent | absent | absent | absent | absent | absent | absent | absent | absent |
| | | | Example | | | | | Comparative Example | | | | | |
| | Blend Composition | | 13 | 14 | 15 | 16 | 17 | 1 | 2 | 3 | 4 | 5 | 6 |
| A | internal olefin sulfonate sodium salt*1 | | 13 | 18 | 18 | 18 | 18 | 18 | 22 | 3 | 22 | 3 | 18 |
| B | palm fatty acid*2 | | 10 | 3 | 5 | 7 | 9 | 0 | 1 | 20 | 1 | 20 | 13 |
| C | ethylene glycol monobutyl ether*3 | | 10 | 12 | 10 | 8 | 6 | 10 | 10 | 10 | 10 | 10 | 2 |
| E | polyoxyethylene(6) lauryl ether*4 | | — | — | — | — | — | — | 10 | 10 | — | — | — |
| | lauryl glucoside*5 | | 10 | — | — | — | — | — | — | — | 10 | 10 | — |
| | citric acid | | 2 | 2 | 2 | 2 | 2 | — | 2 | 2 | 2 | 2 | 2 |
| | monoethanolamine | | q.s. | q.s. | q.s. | q.s. | q.s. | q.s. | q.s. | q.s. | q.s. | q.s. | q.s. |
| | sodium hydroxide | | — | — | — | — | — | — | — | — | — | — | — |
| D | water | | | | | | | | | balance | | | |
| | Total | | 100 | 100 | 100 | 100 | 100 | 100 | 100 | 100 | 100 | 100 | 100 |
| | pH | | 7.9 | 7.7 | 7.6 | 7.8 | 7.9 | 10.4 | 8.7 | 8 | 7.7 | 8 | 8 |
| | A/(B + C) | | 0.65 | 1.2 | 1.2 | 1.2 | 1.2 | 1.8 | 2 | 0.1 | 2 | 0.1 | 1.2 |
| | B/C | | 1 | 0.25 | 0.5 | 0.88 | 1.5 | 0 | 0.1 | 2 | 0.1 | 2 | 6 |
| | B/E | | 1 | — | — | — | — | — | — | — | — | — | — |
| | presence/absence of deposition | | absent | absent | absent | absent | absent | present | present | present | present | present | present |

*1being described in Production Example 1
*2manufactured by Kao Corp., trade name: Lunac L-55, C12: 57%, C14: 22%, C16: 10%, C18: 3%, C18: unsaturated: 6%, C20: a little
*3manufactured by Nippon Nyukazai Co., Ltd., trade name: ethylene glycol monobutyl ether
*4manufactured by Kao Corp., trade name: Emulgen 108
*5manufactured by Kao Corp., trade name: Mydol 12

TABLE 3

| | | | | | | | | | | | | | |
|---|---|---|---|---|---|---|---|---|---|---|---|---|---|
| | | Example | | | | | | | | | | | |
| | Blend Composition | 18 | 19 | 20 | 21 | 22 | 23 | 24 | 25 | 26 | 27 | 28 | 29 |
| A | internal olefin sulfonate sodium salt*1 | 25 | 25 | 25 | 25 | 25 | 25 | 18 | 18 | 18 | 18 | 18 | 18 |
| B | palm fatty acid*2 | 4 | 4 | 4 | 6 | 6 | 6 | 5 | 5 | 5 | 5 | 5 | 5 |
| C | ethylene glycol monobutyl ether*3 | 10 | — | — | 10 | — | — | 10 | — | — | 10 | — | — |
| | benzyl alcohol | — | 10 | — | — | 10 | — | — | 10 | — | — | 10 | — |
| | 2-phenoxyethanol | — | — | 10 | — | — | 10 | — | — | 10 | — | — | 10 |
| E | polyoxyethylene(6) lauryl ether*4 | — | — | — | — | — | — | 9 | 9 | 9 | — | — | — |
| | lauryl glucoside*5 | — | — | — | — | — | — | — | — | — | 9 | 9 | 9 |
| | citric acid | — | — | — | — | — | — | 3 | 3 | 3 | 3 | 3 | 3 |
| | monoethanolamine | q.s. | q.s. | q.s. | q.s. | q.s. | q.s. | — | — | — | — | — | — |
| | sodium hydroxide | — | — | — | — | — | — | q.s. | q.s. | q.s. | q.s. | q.s. | q.s. |
| D | water | balance | balance | balance | balance | balance | balance | balance | balance | balance | balance | balance | balance |
| | Total | 100 | 100 | 100 | 100 | 100 | 100 | 100 | 100 | 100 | 100 | 100 | 100 |
| | pH | 8.3 | 8.8 | 8.9 | 8.1 | 8.2 | 8 | 7.7 | 7.8 | 7.7 | 7.7 | 7.9 | 7.8 |
| | A/(B + C) | 1.8 | 1.8 | 1.8 | 1.6 | 1.6 | 1.6 | 1.2 | 1.2 | 1.2 | 1.2 | 1.2 | 1.2 |
| | B/C | 0.4 | 0.4 | 0.4 | 0.6 | 0.6 | 0.6 | 0.5 | 0.5 | 0.5 | 0.5 | 0.5 | 0.5 |
| | B/E | — | — | — | — | — | — | 0.556 | 0.556 | 0.556 | 0.556 | 0.556 | 0.556 |
| | presence/absence of deposition | absent | absent | absent | absent | absent | absent | absent | absent | absent | absent | absent | absent |

*1being described in Production Example 1
*2manufactured by Kao Corp., trade name: Lunac L-55, C12: 57%, C14: 22%, C16: 10%, C18: 3%, C18: unsaturated: 6%, C20: a little
*3manufactured by Nippon Nyukazai Co., Ltd., trade name: ethylene glycol monobutyl ether
*4manufactured by Kao Corp., trade name: Emulgen 108
*5manufactured by Kao Corp., trade name: Mydol 12

TABLE 4

| | | | Example | | | | | | |
|---|---|---|---|---|---|---|---|---|---|
| | | | 30 | 31 | 32 | 33 | 34 | 35 | 36 |
| A | | internal olefin sulfonate sodium salt (A1)*1 | 10 | 10 | 10 | 10 | 10 | 10 | 30 |
| B | | palm fatty acid*2 | 4 | 4 | 4 | 6 | 6 | 6 | 4 |
| C | C4 | ethylene glycol monobutyl ether*3 | 10 | — | — | 10 | — | — | 10 |
| | C6 | benzyl alcohol | — | 10 | — | — | 10 | — | — |
| | C6 | 2-phenoxyethanol | — | — | 10 | — | — | 10 | — |
| E | | polyoxyethylene(6) lauryl ether*4 | — | — | — | — | — | — | — |
| | | lauryl glucoside*5 | — | — | — | — | — | — | — |
| | | citric acid | — | — | — | — | — | — | — |
| | | monoethanolamine | q.s. | q.s. | q.s. | q.s. | q.s. | q.s. | q.s. |
| | | sodium hydroxide | — | — | — | — | — | — | — |
| D | | water | balance | balance | balance | balance | balance | balance | balance |
| Total | | | 100 | 100 | 100 | 100 | 100 | 100 | 100 |
| pH | | | 8.0 | 7.92 | 8.04 | 7.92 | 8.01 | 7.96 | 8.9 |
| A/(B + C) | | | 0.7 | 0.7 | 0.7 | 0.6 | 0.6 | 0.6 | 2.1 |
| B/C | | | 0.4 | 0.4 | 0.4 | 0.6 | 0.6 | 0.6 | 0.4 |
| B/E | | | — | — | — | — | — | — | — |
| presence/absence of deposition | | | absent | absent | absent | absent | absent | absent | absent |

| | | | Example | | | | | |
|---|---|---|---|---|---|---|---|---|
| | | | 37 | 38 | 39 | 40 | 41 | 42 |
| A | | internal olefin sulfonate sodium salt (A1)*1 | 30 | 30 | 30 | 30 | 30 | 35 |
| B | | palm fatty acid*2 | 4 | 4 | 6 | 6 | 6 | 4 |
| C | C4 | ethylene glycol monobutyl ether*3 | — | — | 10 | — | — | — |
| | C6 | benzyl alcohol | 10 | — | — | 10 | — | 10 |
| | C6 | 2-phenoxyethanol | — | 10 | — | — | 10 | — |
| E | | polyoxyethylene(6) lauryl ether*4 | — | — | — | — | — | — |
| | | lauryl glucoside*5 | — | — | — | — | — | — |
| | | citric acid | — | — | — | — | — | — |
| | | monoethanolamine | q.s. | q.s. | q.s. | q.s. | q.s. | q.s. |
| | | sodium hydroxide | — | — | — | — | — | — |
| D | | water | balance | balance | balance | balance | balance | balance |
| Total | | | 100 | 100 | 100 | 100 | 100 | 100 |
| pH | | | 8.02 | 8.77 | 7.89 | 7.89 | 8.39 | 7.94 |
| A/(B + C) | | | 2.1 | 2.1 | 1.9 | 1.9 | 1.9 | 2.5 |
| B/C | | | 0.4 | 0.4 | 0.6 | 0.6 | 0.6 | 0.4 |
| B/E | | | — | — | — | — | — | — |
| presence/absence of deposition | | | absent | absent | absent | absent | absent | absent |

*1 to *5: the same as in Table 2

TABLE 5

| | | | Example | | | |
|---|---|---|---|---|---|---|
| | | | 43 | 44 | 45 | 46 |
| A | | internal olefin sulfonate sodium salt (A1)*1 | 10 | 10 | 18 | 14 |
| B | | palm fatty acid*2 | 0.5 | 1 | 2 | 14 |
| C | C4 | ethylene glycol monobutyl ether*3 | — | — | 4 | 8 |
| | C6 | 2-phenoxyethanol | 10 | 10 | — | — |
| E | | polyoxyethylene(6) lauryl ether*4 | — | — | 5 | 5 |
| | | lauryl glucoside*5 | — | — | — | — |
| | | citric acid | — | — | — | — |

TABLE 5-continued

| | | Example | | | |
|---|---|---|---|---|---|
| | | 43 | 44 | 45 | 46 |
| | monoethanolamine | q.s. | q.s. | q.s. | q.s. |
| | sodium hydroxide | — | — | — | — |
| D | water | balance | balance | balance | balance |
| Total | | 100 | 100 | 100 | 100 |
| pH | | 9.57 | 9.3 | 9.46 | 7.91 |
| A/(B + C) | | 1.0 | 0.9 | 3.0 | 0.6 |
| B/C | | 0.05 | 0.10 | 0.50 | 1.8 |
| B/E | | — | — | — | — |
| presence/absence of deposition | | absent | absent | absent | absent |

*1 to *5: the same as in Table 2

TABLE 6

| | | | Example | | | | | | | | |
|---|---|---|---|---|---|---|---|---|---|---|---|
| | | | 47 | 48 | 49 | 50 | 51 | 52 | 53 | 54 | 55 |
| A | | internal olefin sulfonate sodium salt (A1)*1 | 18 | 18 | 18 | 18 | 18 | 18 | 18 | 18 | 18 |
| B | | palm fatty acid*2 | 5 | 4 | 4 | 4 | 4 | 4 | 4 | 5 | 5 |
| C | C1 | butanol | 10 | — | — | — | — | — | — | 10 | 10 |
| | C1 | ethanol | — | 0.5 | — | — | — | — | — | — | — |
| | C2 | glycerol | — | — | 1 | — | — | — | — | — | — |
| | C2 | ethylene glycol | — | — | — | 1 | — | — | — | — | — |
| | C2 | butylene glycol | — | — | — | — | 1 | — | — | — | — |
| | C3 | diethylene glycol | — | — | — | — | — | 1 | — | — | — |
| | C4 | ethylene glycol monobutyl ether*3 | — | 0.5 | — | — | — | — | — | — | — |
| | C5 | 1-methylglycerol ether | — | — | — | — | — | — | 1 | — | — |
| | C6 | 2-phenoxyethanol | — | 9 | 9 | 9 | 9 | 9 | 9 | — | — |
| E | | polyoxyethylene(6) lauryl ether*4 | — | — | — | — | — | — | — | 9 | — |
| | | lauryl glucoside*5 | — | — | — | — | — | — | — | — | 9 |
| | | citric acid | — | — | — | — | — | — | — | 2 | 2 |
| | | monoethanolamine | q.s. | q.s. | q.s. | q.s. | q.s. | q.s. | q.s. | q.s. | q.s. |
| | | sodium hydroxide | — | — | — | — | — | — | — | — | — |
| D | | water | balance | balance | balance | balance | balance | balance | balance | balance | balance |
| Total | | | 100 | 100 | 100 | 100 | 100 | 100 | 100 | 100 | 100 |
| pH | | | 8.01 | 7.89 | 7.93 | 7.95 | 8.1 | 7.97 | 8.52 | 7.87 | 8.09 |
| A/(B + C) | | | 1.2 | 1.3 | 1.3 | 1.3 | 1.3 | 1.3 | 1.3 | 1.2 | 1.2 |
| B/C | | | 0.5 | 0.4 | 0.4 | 0.4 | 0.4 | 0.4 | 0.4 | 0.5 | 0.5 |
| B/E | | | — | — | — | — | — | — | — | 0.556 | 0.556 |
| presence/absence of deposition | | | absent | absent | absent | absent | absent | absent | absent | absent | absent |

*1 to *5: the same as in Table 2

TABLE 7

| | | | Example | | | |
|---|---|---|---|---|---|---|
| | | | 56 | 57 | 58 | 59 |
| A | | internal olefin sulfonate sodium salt (A1)*1 | 10 | 18 | 18 | 10 |
| B | | palm fatty acid*2 | 1 | 1.5 | 2 | 4 |
| C | C4 | ethylene glycol monobutyl ether*3 | 6.5 | — | — | 10 |
| | C6 | benzyl alcohol | — | — | 13 | — |
| | C6 | 2-phenoxyethanol | — | 10 | — | — |
| E | | polyoxyethylene(6) lauryl ether*4 | 0.5 | 1 | 1 | 20 |
| | | lauryl glucoside*5 | — | — | — | — |
| | | citric acid | 2 | 2 | 2 | 2 |
| | | monoethanolamine | q.s. | q.s. | q.s. | q.s. |
| | | sodium hydroxide | — | — | — | — |
| D | | water | balance | balance | balance | balance |
| Total | | | 100 | 100 | 100 | 100 |
| pH | | | 9.11 | 8.07 | 8.56 | 8.07 |
| A/(B + C) | | | 1.3 | 1.6 | 1.2 | 0.7 |
| B/C | | | 0.2 | 0.2 | 0.2 | 0.4 |
| B/E | | | 2.0 | 1.5 | 2.0 | 0.2 |
| presence/absence of deposition | | | absent | absent | absent | absent |

*1 to *5: the same as in Table 2

TABLE 8

| | | | Example | | | |
|---|---|---|---|---|---|---|
| | | | 60 | 61 | 62 | 63 |
| A | | internal olefin sulfonate sodium salt (A1)*1 | 10 | 18 | 18 | 10 |
| B | | palm fatty acid*2 | 1 | 1.5 | 2 | 4 |
| C | C4 | ethylene glycol monobutyl ether*3 | 6.5 | — | — | 10 |

TABLE 8-continued

| | | | Example | | | |
|---|---|---|---|---|---|---|
| | | | 60 | 61 | 62 | 63 |
| | C6 | benzyl alcohol | — | — | 13 | — |
| | C6 | 2-phenoxyethanol | — | 10 | — | — |
| E | | polyoxyethylene(6) lauryl ether*4 | — | — | — | — |
| | | lauryl glucoside*5 | 0.5 | 1 | 1 | 20 |
| | | citric acid | 2 | 2 | 2 | 2 |
| | | monoethanolamine | q.s. | q.s. | q.s. | q.s. |
| | | sodium hydroxide | — | — | — | — |
| D | | water | balance | balance | balance | balance |
| Total | | | 100 | 100 | 100 | 100 |
| pH | | | 7.98 | 8.63 | 8.16 | 8.04 |
| A/(B + C) | | | 1.3 | 1.6 | 1.2 | 0.7 |
| B/C | | | 0.2 | 0.2 | 0.2 | 0.4 |
| B/E | | | 2.0 | 1.5 | 2.0 | 0.2 |
| presence/absence of deposition | | | absent | absent | absent | absent |

*1 to *5: the same as in Table 2

TABLE 9

| | | | Example 64 |
|---|---|---|---|
| A | | internal olefin sulfonate sodium salt(A2)*1 | 18 |
| B | | palm fatty acid*2 | 2 |
| C | C4 | ethylene glycol monobutyl ether*3 | — |
| | C6 | benzyl alcohol | — |
| | C6 | 2-phenoxyethanol | 10 |

TABLE 9-continued

| | | Example 64 |
|---|---|---|
| E | polyoxyethylene(6) lauryl ether*4 | — |
| | lauryl glucoside*5 | — |
| | citric acid | — |
| | monoethanolamine | q.s. |
| | sodium hydroxide | — |
| D | water | balance |
| Total | | 100 |
| pH | | 8.09 |
| A/(B + C) | | 1.5 |
| B/C | | 0.2 |
| B/E | | — |
| presence/absence of deposition | | absent |

*1 to *5: the same as in Table 2

TABLE 10

| | | | Example 65 |
|---|---|---|---|
| A | | internal olefin sulfonate sodium salt(A3)*1 | 18 |
| B | | palm fatty acid*2 | 2 |
| C | C4 | ethylene glycol monobutyl ether*3 | — |
| | C6 | benzyl alcohol | — |
| | C6 | 2-phenoxyethanol | 10 |
| E | | polyoxyethylene(6) lauryl ether*4 | — |
| | | lauryl glucoside*5 | — |
| | | citric acid | — |
| | | monoethanolamine | q.s. |
| | | sodium hydroxide | — |
| D | | water | balance |
| Total | | | 100 |
| pH | | | 8.62 |
| A/(B + C) | | | 1.5 |
| B/C | | | 0.2 |
| B/E | | | — |
| presence/absence of deposition | | | absent |

*1 to *5: the same as in Table 2

From Table 1 to Table 10, the liquid detergent compositions according to the present invention not only had excellent detergency but also exhibited no deposition of the surfactant and was stable even at a low temperature condition of −5° C. Comparative Example 1 was an example comprising no Component (B). Comparative Example 2 and Comparative Example 4 were examples having a B/C ratio beyond the scope of the B/C ratio according to the present invention. Comparative Example 3 and Comparative Example 5 were examples having a low content of the component (A), a high content of the component (B) and a low A/(B+C). Comparative Example 6 was an example having a high B/C. These Comparative Examples were insufficient in the low-temperature stability.

The invention claimed is:

1. A liquid detergent composition comprising the following components (A) to (D), wherein a mass ratio of the component (A) to a total amount of the component (B) and the component (C), (A/(B+C)), is 0.6 or more and 5 or less; and a mass ratio of the component (B) to the component (C), (B/C), is 0.05 or more and 1.8 or less:

(A): 10 to 40% by mass of an internal olefin sulfonate salt having 16 or more and 18 or less carbon atoms in which a content of an internal olefin sulfonate salt having a sulfonic group at the C-2 position is 5% by mass or more and 25% by mass or less;

(B): 0.5 to 16% by mass of a fatty acid salt represented by the following formula (1)

$$R^1COOM \quad (1)$$

wherein $R^1$ represents an alkyl group or alkenyl group having 10 or more and 14 or less carbon atoms; and M represents a hydrogen atom, an alkali metal, alkaline earth metal (½ atom), ammonium or an organic ammonium;

(C): an organic solvent having one or more hydroxyl groups; and (D): water.

2. The liquid detergent composition according to claim 1, further comprising 0.1% by mass or more and 40% by mass or less of a nonionic surfactant as a component (E).

3. The liquid detergent composition according to claim 2, wherein the nonionic surfactant as the component (E) is at least one selected from the group consisting of (e1) represented by the following formula (2) and (e2) represented by the following formula (3):

$$(e1):\ R^2O(XO)_mH \quad (2)$$

wherein $R^2$ represents a hydrocarbon group having 10 or more and 18 or less carbon atoms; XO represents an ethyleneoxy group or a propyleneoxy group; and m represents an average number of moles added and is the number of 4 or more and 10 or less; and $$(e2):\ R^3(OR^4)_wG_y \quad (3)$$

wherein $R^3$ represents a hydrocarbon group having 8 to 18 carbon atoms; $R^4$ represents an alkylene group having 2 to 4 carbon atoms; G represents a residue originated from a reducing sugar having 5 to 6 carbon atoms; w represents an average number of moles added of 0 to 5, and y represents an average number of moles added of 1 to 10.

4. The liquid detergent composition according to claim 3, wherein $R^2$ in the (e1) is a hydrocarbon group having 10 or more and 14 or less carbon atoms.

5. The liquid detergent composition according to claim 3, wherein $R^3$ in the (e2) is a hydrocarbon group having 10 or more and 14 or less carbon atoms.

6. The liquid detergent composition according claim 2, wherein a content of the component (E) is 0.5% by mass or more and 30% by mass or less.

7. The liquid detergent composition according to claim 1, wherein the counter ion M of the component (B) is an alkanolamine.

8. The liquid detergent composition according to claim 1, wherein the organic solvent having one or more hydroxyl groups as the component (C) is at least one selected from the group consisting of monohydric alcohols, polyhydric alcohols and polyhydric alcohol ethers.

9. The liquid detergent composition according to claim 1, wherein the organic solvent having one or more hydroxyl groups as the component (C) is at least one selected from the group consisting of the following components (c1) to (c6):

(c1): monohydric alcohols having an aliphatic hydrocarbon group having 2 or more and 6 or less carbon atoms;

(c2): di- or more hydric and hexa- or less hydric alcohols having 2 or more and 6 or less carbon atoms (excluding component (c3));

(c3): polyalkylene glycols comprising an alkylene glycol unit having 2 or more and 4 or less carbon atoms;

(c4): monoalkyl ethers of (mono or poly)alkylene glycols, having an alkylene glycol unit having 2 or more and 4 or less carbon atoms and an alkyl group having 1 or more and 4 or less carbon atoms;

(c5): alkyl glyceryl ethers having alkyl having 1 or more and 8 or less carbon atoms; and (c6): aromatic compounds having an alcoholic hydroxyl group.

10. The liquid detergent composition according to claim 1, wherein the organic solvent having one or more hydroxyl groups as the component (C) is at least one or two or more selected from the group consisting of ethanol, ethylene glycol, propylene glycol, glycerol, ethylene glycol monobutyl ether, 2-phenoxyethanol and benzyl alcohol.

11. A method for cleaning clothes, comprising cleaning clothes by using a cleaning solution having a temperature of 0° C. or more and 35° C. or less comprising water and 0.01% by mass or more and 0.1% by mass or less of the liquid detergent composition according to claim 1 under the condition that a bath ratio represented by a ratio of a volume (L) of the cleaning solution to a mass of the clothes, a volume (L) of the cleaning solution/a mass (kg) of the clothes, is 3 or more and 50 or less.

12. The method for cleaning clothes according to claim 11, wherein the cleaning of clothes is carried out by using a rotary washing machine.

13. The liquid detergent composition according to claim 1, wherein pH at 20° C. is 6.5 or more and 13 or less.

14. The liquid detergent composition according to claim 1, wherein a mass ratio of the component (B) to the component (C), (B/C), is 0.15 or more and 1.8 or less.

* * * * *